US005702102A

United States Patent [19]

Ballard

[11] Patent Number: 5,702,102

[45] Date of Patent: Dec. 30, 1997

[54] SCORE BOARD FOR DART GAME

[76] Inventor: Philip R. Ballard, 26 Hamlet St., Springfield, Mass. 01104

[21] Appl. No.: 510,200

[22] Filed: Aug. 2, 1995

[51] Int. Cl.[6] ..... A63B 9/00; G09F 9/00; G06C 27/00

[52] U.S. Cl. ..... 273/148 R; 273/DIG. 26; 273/408; 116/321; 116/222; 235/68

[58] Field of Search ..... 116/222, 315, 116/321; 235/68, 69, 91 B, 90; 273/148 R, DIG. 26, 408

[56] References Cited

U.S. PATENT DOCUMENTS

| | | | |
|---|---|---|---|
| 144,523 | 11/1873 | Esersky | 235/68 |
| D. 368,863 | 4/1996 | Ballard | D10/46.1 |
| 465,811 | 12/1891 | Anderson | 235/68 |
| 596,665 | 1/1898 | Porter | 235/68 |
| 909,823 | 1/1909 | Roscoe | 235/68 |
| 2,454,891 | 11/1948 | Spause | 116/222 |
| 2,461,811 | 2/1949 | Cusano | 116/222 |
| 3,722,461 | 3/1973 | Furman | 235/91 B |
| 4,171,807 | 10/1979 | Lamlee | 273/DIG. 26 |
| 4,185,583 | 1/1980 | Stamm | 273/DIG. 26 |
| 4,948,148 | 8/1990 | Danielson | 273/DIG. 26 |
| 5,062,381 | 11/1991 | Hendricks | 116/222 |
| 5,438,950 | 8/1995 | Rodrigues | 273/DIG. 26 |

*Primary Examiner*—Benjamin H. Layno
*Assistant Examiner*—Stephen L. Blau
*Attorney, Agent, or Firm*—Cesari and McKenna, LLP

[57] ABSTRACT

A dart score board has tokens moveable along tracks, each track corresponding to a region of a dart board. The score board also has point-score-keeping elements, such as sets of thumbwheels. Players record the progress (status) of a dart game by moving the tokens along the tracks and by advancing the point-score-keeping elements.

5 Claims, 5 Drawing Sheets

SCORE BOARD FOR DART GAME

FIELD OF THE INVENTION

The invention relates to a game score board, and more particularly to a score board for the game of darts.

BACKGROUND OF THE INVENTION

A variety of dart games are based on successive attempts by one or more players to propel darts and land them on particular regions of a target. The target consists of a circle that defines a "bull's-eye" region and is otherwise divided by radial lines into 20 "pie" shaped regions, each region having an associated number (point value). The point values of the pie-shaped regions are between 1 and 20, while the point value of the bull's-eye region is 25. Two pairs of concentric circles overlay the 20 pie-shaped regions and define two narrow "bands" in which the point values of the regions are doubled and tripled, respectively. The bull's-eye region contains an inner circle in which its point valve is doubled.

"Cricket", the most popular dart game in the United States, and most other dart games have elaborate scoring rules. In Cricket, the object is to be the first player to land three darts in each of the bull's-eye and six of the pie-shaped regions and to score the most points. A player scores points by landing one or more additional darts (beyond the required three) in a region before any other player has landed three darts in (i.e., "closed-out") the region. For each such dart landed, the player earns a number of points equal to the point value of the region multiplied by one, two, or three, as appropriate.

Players may land darts in, and therefore close-out, the regions in any order, hence players require a score board for keeping track of the status of a dart game, i.e. the number of darts each player has landed in each region, which regions are closed-out and a running total of each player's point score. Typically, this information is recorded on a score board (often a chalk board or simply a piece of paper) having a column for each player and a row for the bull's-eye region and each of the six pie-shaped regions. After a player lands a dart in a region he makes a mark on the corresponding portion of the score board: a diagonal line for the first dart landed in the region, a crossing diagonal line for the second dart landed in the region, and a circle centered on the two crossing diagonal lines to close-out the region. Also on the score board, below each column, the player records his running point score, which entails erasing the previous score and writing an updated score.

Many dart games are played in taverns. Problematically, in such an environment it is difficult to provide a ready supply of chalk and an eraser and to keep a chalk board clean enough to make the writing thereon legible. The alternative of keeping score on a paper napkin is generally unsatisfactory because the napkin is not durable so it cannot withstand repeated erasures, especially when it becomes wet, and in any case the score is not simultaneously visible to the players and any assembled onlookers.

Practitioners have attempted to overcome these problems with a variety of designs for dart score boards. Danielson (U.S. Pat. No. 5,054,792) describes a scoring panel having a modular pattern of marker positions that can releasably hold markers to indicate the progress of a game. However, and quite problematically, these markers, once released from the panel, can easily be misplaced or stolen. Jones, et al. (U.S. Pat. No. 5,318,319) describe a battery-powered dart game that employs colored lamps to indicate the progress of a game. While the score board of Jones has no loose parts, it requires frequent battery changes.

It is, therefore, an objective to provide a score board for the game of darts that has no loose parts and does not require electrical power.

Other objectives will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts which are adapted to effect such steps, all as exemplified in the following detailed description, and the scope of the invention will be indicated in the claims.

SUMMARY OF THE INVENTION

The invention provides a score board in which tokens are moveable along tracks, each track corresponding to a region of a dart board. The score board is initialized by moving all the tokens to one end of their respective tracks. After a player lands a dart in a region, he moves one token, or two or three tokens if he landed the dart in a doubled or tripled portion of the region, to the other end of the track that corresponds to the region. The third token to be moved along each track can be visually distinct from the other tokens on the track to facilitate indicating that the associated region is closed-out.

The score board includes a point-score-keeping element, for example a set of thumb wheels, for each player by which the player can easily update his running point score.

BRIEF DESCRIPTION OF THE DRAWINGS

The above and further advantages of the invention may be better understood by referring to the following description in conjunction with the accompanying drawings in which.

DESCRIPTION OF THE PREFERRED EMBODIMENTS

Figure 1:
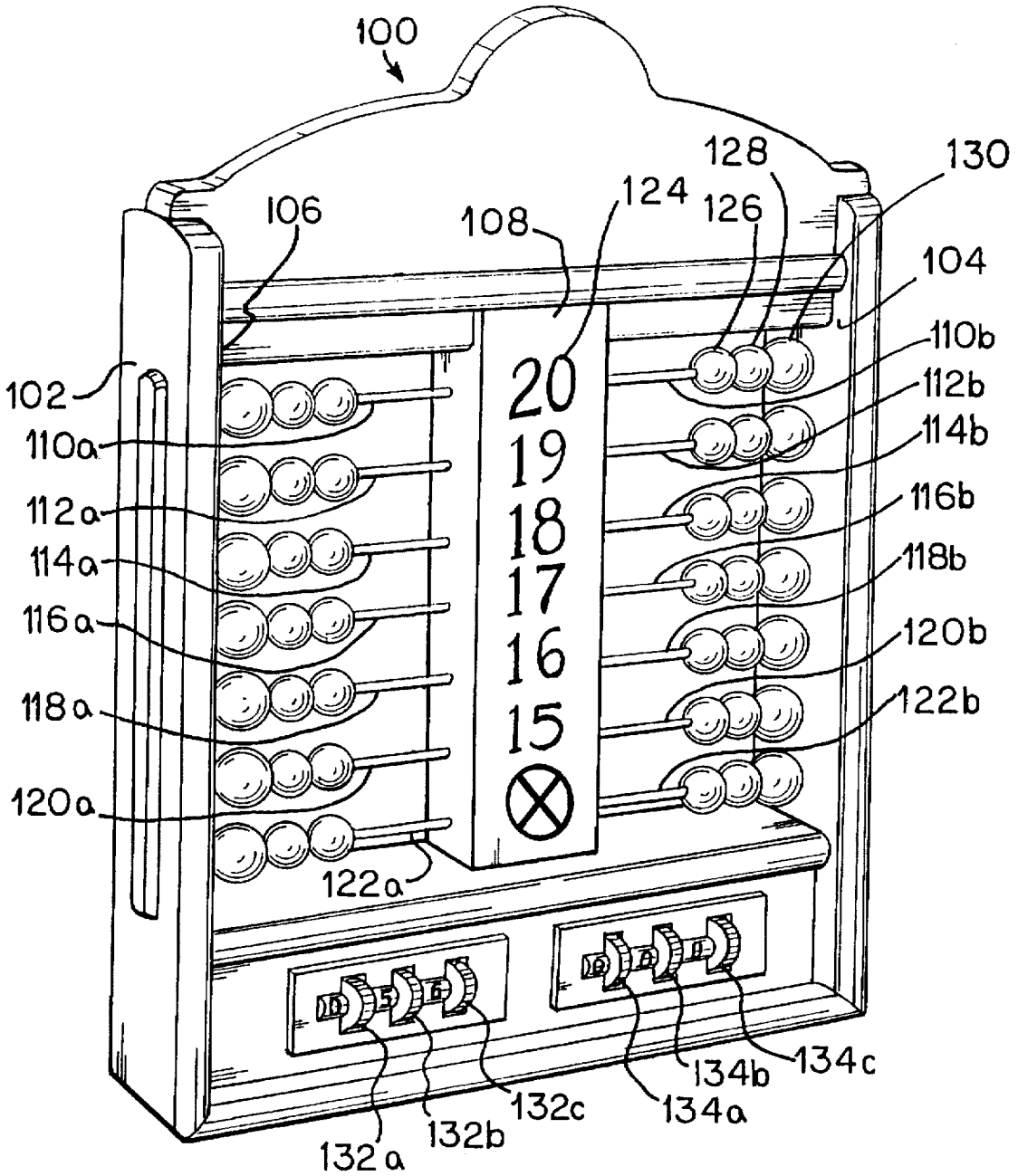
FIG. 1 is a perspective view of the preferred embodiment of the dart score board.

FIG. 1 shows generally at 100 a score board having a housing 102 with counterfacing sides 104 and 106, a partition 108 between the counterfacing sides, and substantially parallel rods 110–122 extending from one of the counterfacing sides, through the partition, to the other counterfacing side. Indicia, such as indicia 124, adjacent each rod correlates the rods to regions of a dart board. Each rod is divided by the partition 108 into two portions. For example rod 110 is divided into portions 110*a* and 110*b*. Rod portions 110*a*–122*a* constitute a column of tracks that correspond to a player while rod portions 110*b*–122*b* constitute a column of tracks that correspond to another player.

Each rod has two sets of three "close-out" tokens, such as tokens 126, 128 and 130, slideably mounted thereto. Each token has a bore though which the rod extends, whereby each token can be moved (slid) along the rod, but the partition 108 prevents the token from being slid from one portion of the rod to the other portion.

Figure 2:
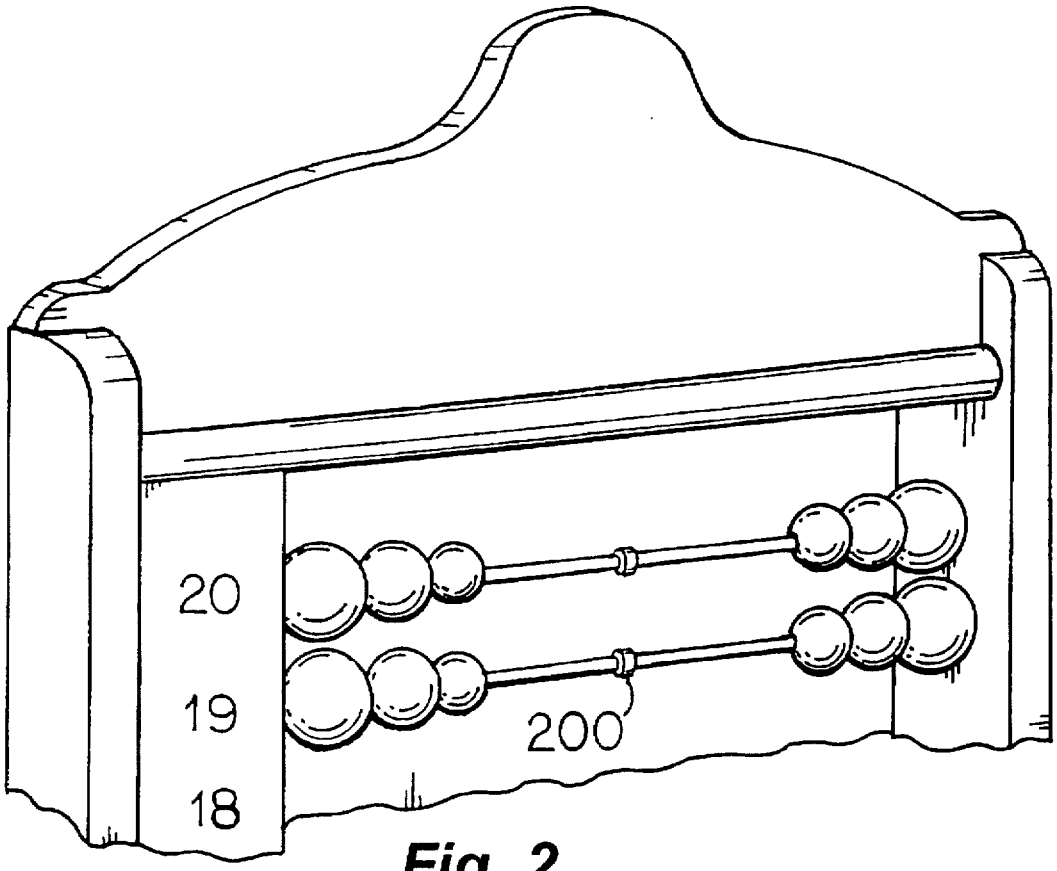
FIG. 2 is a perspective view of a portion of an alternative embodiment of the dart score board.

Alternatively, as shown in FIG. 2, the score board can be constructed without a partition. In the embodiment in FIG. 2, each rod has a boss, such as boss 200, which prevents tokens from being slid from one portion of a rod to the other portion. Other alternatives exist for the partition and boss; any construction, for example a bend in each rod, that prevents tokens from being slid from one portion of a rod to the other portion is adequate.

Preferably, the third token of each set of tokens, such as token 130 (FIG. 1), is larger and a different color than the first and second tokens of the set, such as tokens 126 and 128, to visually distinguish the third from the first and second tokens. Alternatively other attributes, for example shape, color alone, size alone, or a combination of these attributes, visually distinguish the tokens.

Figure 3:
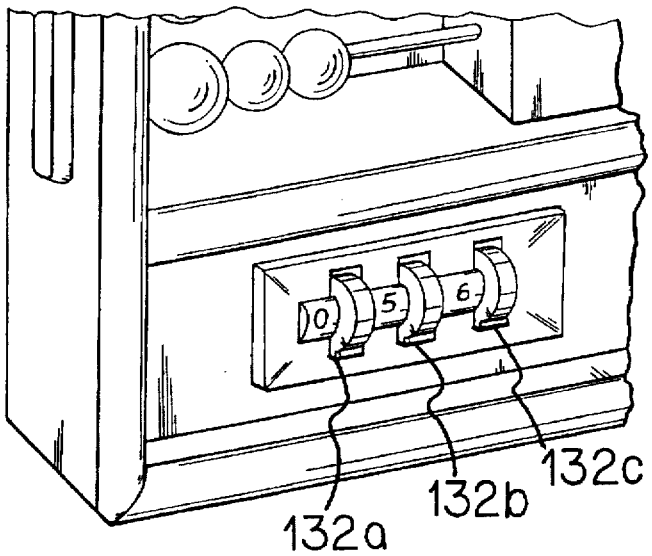
FIG. 3 is a close-up view of the point-score-keeping element of the preferred embodiment.

A point-score-keeping element is attached to the housing 102 below each column of rod portions 110*a*–122*a* and 110*b*–122*b* and is visibly associated with the column by its proximity to the column. Each point-score-keeping element and the column of rod portions (tracks) below which it is attached correspond to the same player. Preferably, the point-score-keeping elements are thumbwheels 132*a*–*c* and 134*a*–*c*. As shown in FIG. 3, each thumbwheel, such as thumbwheel 132*a*, can display the digits 0–9, thus three thumbwheels can display a score between 000 and 999. When a player has closed out a region and he lands a dart in the region before any other player has closed out the region, he advances the corresponding point-score-keeping element by the value of the region multiplied by one, two, or three as appropriate. Thus the tokens and the point-score-keeping elements cooperate to indicate a game status. Alternatively, another kind of mechanical, electromechanical, or electronics point-score-keeping element can be employed, such as a so-called "flip digital" display similar to that used in some alarm clocks.

Figure 4:
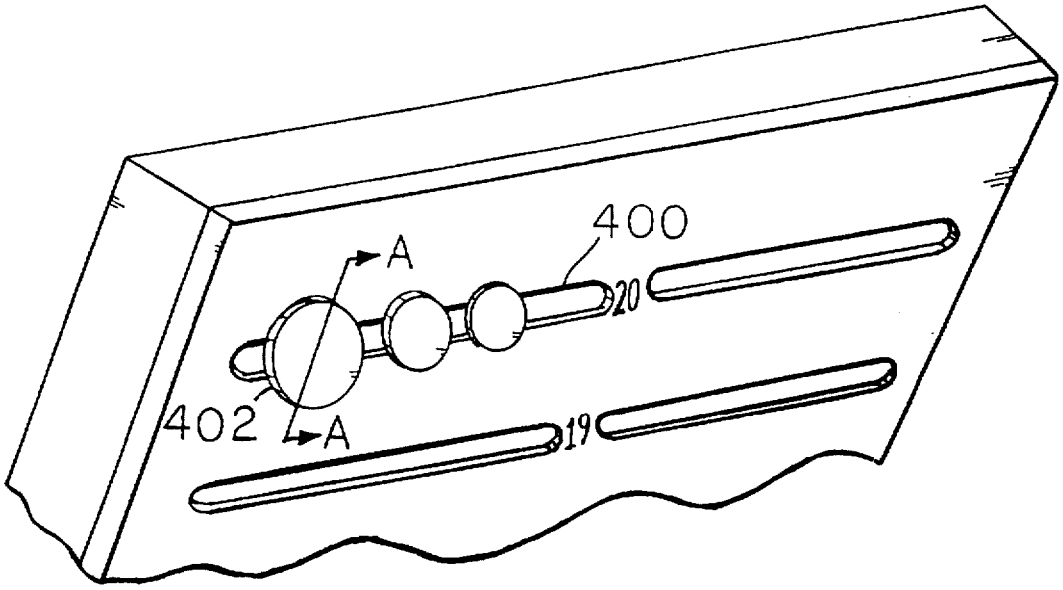
FIG. 4 is a perspective view of a portion of another embodiment of the dart score board.
Figure 5:
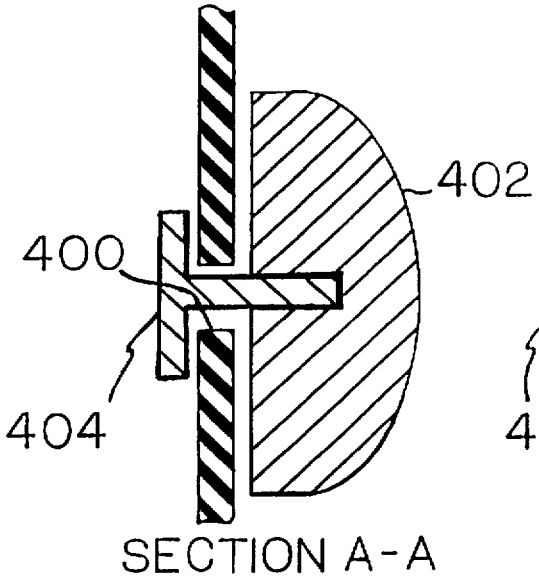
FIG. 5 is a sectional view of a token in FIG. 4.
Figure 6:
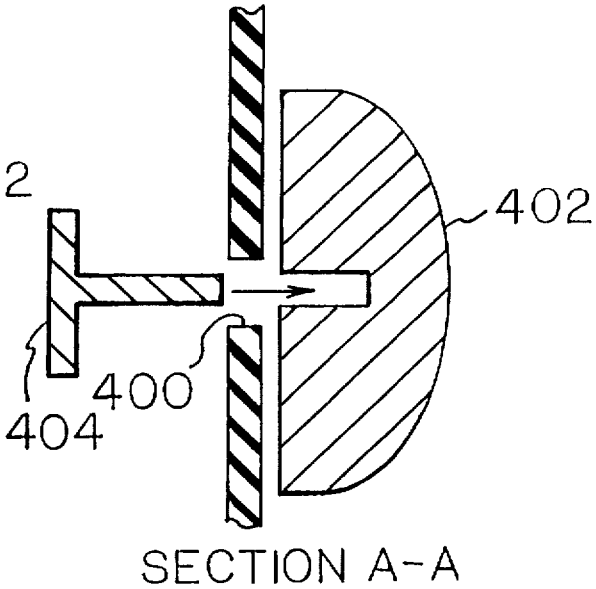
FIG. 6 is an exploded view of the token in FIG. 5.

In an alternative embodiment shown in FIGS. 4–6 the tracks are slots, such as slot 400, and the close-out tokens, such as token 402, slideably engage the slots. The slideable engagement can be accomplished in many ways, for example as shown in FIG. 5 the stem of a flange piece 404 protrudes through the slot 400 and is secured, e.g., by an adhesive, in a recess in the rear of the token 402. FIG. 6 shows an exploded view of the token 402 and the flange piece 404.

Figure 7:
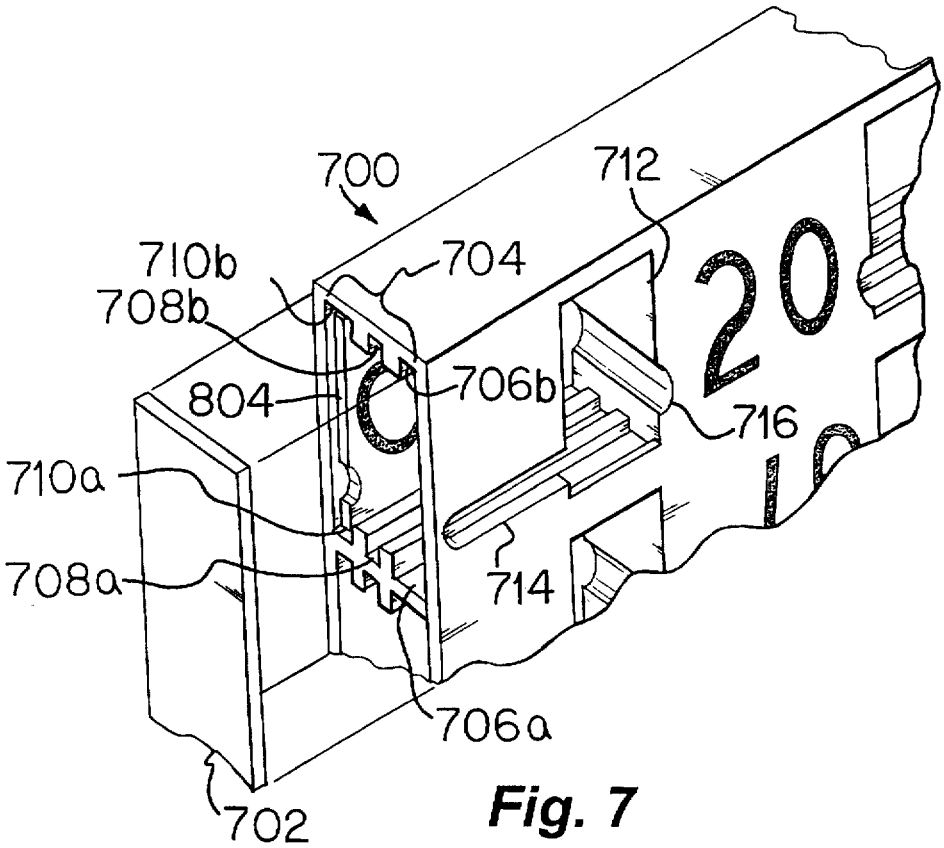
FIG. 7 is an exploded perspective view of the upper-left portion of yet another embodiment of the dart score board.
Figure 8:
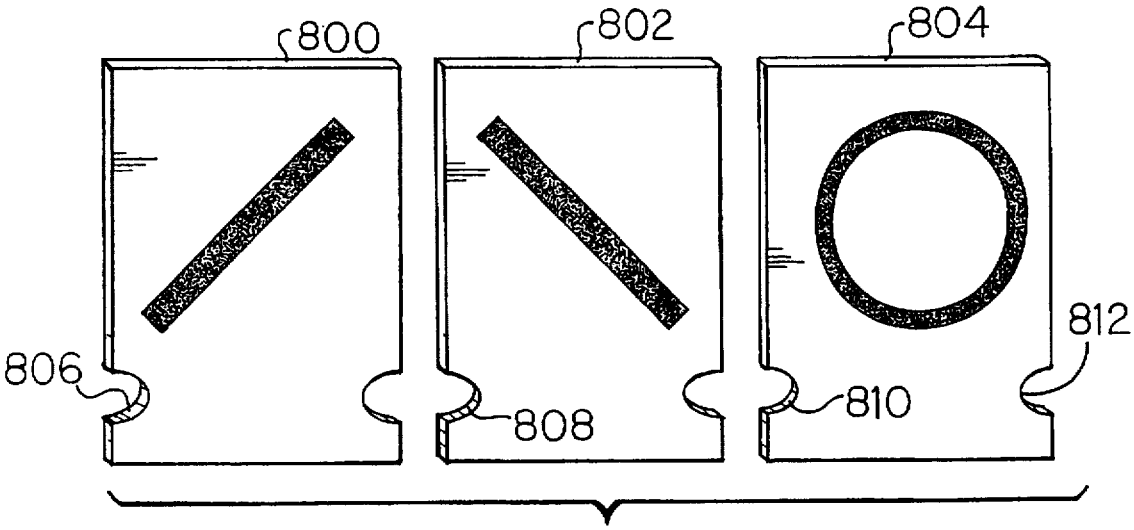
FIG. 8 illustrates a representative set of tokens of the embodiment in FIG. 7.

In another embodiment shown in FIGS. 7 and 8, the tokens are plates, such as plates 800, 802, and 804 (FIG. 8), having opaque or translucent indicia thereon. Preferably, the indicia correspond to the marks made on a traditional dart score board. The first and second plates, 800 and 802, respectively, are substantially transparent or translucent apart from the indicia, hereinafter referred to as "substantially transparent." Thus if the first and second, and optionally the third, plates were to be "stacked" together they would form an image that is the composite of their respective indicia. FIG. 7 shows generally at 700 a portion of the dart score board with its end plate 702 removed to reveal that an exemplary track 704 comprises three subtracks 706*a* and *b*, 708*a* and *b* and 710*a* and *b*. A plate is slideably mounted to each subtrack, but for clarity only the third plate 804 is shown in FIG. 7. Although each subtrack comprises two parts, e.g. 706*a* and 706*b*, practitioners skilled in the art will recognize that a subtrack can be built using only one part and that a track need not contain three subtracks. Furthermore, tokens can be made moveable along tracks by means other than sliding. For example, tokens in any embodiment can be made moveable by wheels.

The front of the score board has an opening 712 adjacent one end of the track 704 so that any plate that has been moved (slid) to the end of the track is visible through the opening. The track 704 is at least twice as long as the width of a plate, thus any plate that has been slid to the other end of the track is not visible through the opening 712. None, one, two, or all three of the plates can be selectively slid to the end of the track 704 and can thus be made visible through the opening 712 because the first and second plates mounted to subtracks 706*a* and *b* and 708*a* and *b*, respectively, are substantially transparent.

When a player lands a dart on a region of the dart board, he slides the first plate 800 to the end of the track 704 and makes its indicia, a single diagonal line, visible through the opening 712. When the second plate 802 is slid into position behind the first plate 800, the composite image formed by the two plates is two crossing diagonal lines. When the third plate 804, which need not be substantially transparent, is slid into position behind the first two plates, the composite image formed by the three plates is a circle circumscribing two crossing diagonal lines.

Finger slot 714 facilitates inserting a finger into the score board to slide one or more of the plates toward the opening 712. As shown in FIG. 8, the plates 800–804 have finger notches 806–810 of varying depths to provide tactile feedback while selecting a plate and to facilitate sliding the plate(s) toward the opening 712. The first-to-be-slid plate 800 has the deepest notch and subsequently-selected plates have progressively shallower notches. Preferably, the order in which the plates in a track are to be slid into view corresponds to the placement of their respective subtracks. The first-to-be-slid plate is mounted to the subtrack that is closest to the front of the score board, i.e. subtrack 706*a* and *b*, and subsequently-slid plates are mounted to subtracks that are progressively further from the front of the score board. A second finger notch in each plate, such as finger notch 812, and a second finger slot 716 (FIG. 7) facilitate initializing the score board by sliding the plates back to the other end of the track.

Figure 9:
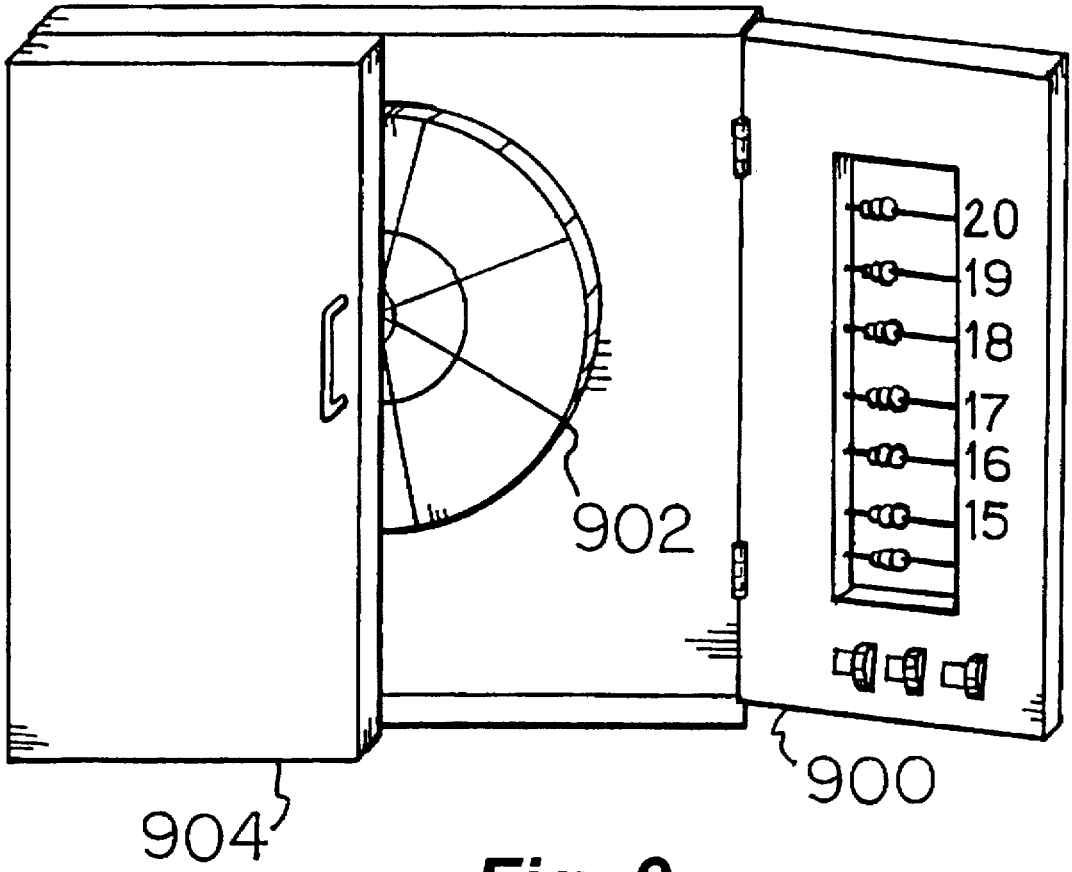
FIG. 9 is a perspective view of yet another embodiment of the dart score board.

In some other embodiments, only the tracks and point-score-keeping element corresponding to a single player are present. FIG. 9 illustrates an embodiment in which the tracks and point-score-keeping element are part of a hinged panel 900 that opens to reveal a dart board 902. Optionally, the other panel 904 can have a second set of tracks and a second point-score-keeping element.

Although the preferred and alternative embodiments have been described with reference to the game of Cricket, practioners skilled in the art will recognize that by varying the number and configuration of tracks and/or point-score-keeping elements, the number of tokens and the indicia, the invention can be made applicable to other dart games. It will therefore be seen that I have developed score board for the game of darts and method of score-keeping a game of darts, which can be utilized with a variety of dart games. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A score board for dart games utilizing a dart board having a plurality of predetermined regions thereon, the score hoard comprising:

(a) housing having a back and a pair of outer counterfacing sides disposed vertically the outer counterfacing sides extending outwardly from the back and defining therebetween a hollow space;

(b) a partition region disposed vertically between each of the counterfacing sides and defining, thereby, within the hollow space a pair of vertically oriented channels, each having one of the counterfacing sides as an outer wall;

(c) plurality of substantially horizontally oriented rods located between each of the counterfacing sides and the partition region, the rods being seated within each of channels;

(d) indicia markings located respectively adjacent each of the rods, the indicia markings being indicative of each of the predetermined regions;

(e) a plurality of tokens located on each of the rods, the tokens being moveable between a position adjacent to one of the counterfacing walls, and a position adjacent the partition region to thereby, indicate a status of the predetermined region, each of the tokens being at least completely disposed within the channel with the counterfacing side extending outwardly from the back beyond the tokens; and (f) a pair of adjustable point-score-keeping elements each located with respect to each of the channels, wherein each of the point-scored-keeping elements is located below a respective of the channels on a portion of the housing within the counterfacing sides, each of the point score keeping elements including a moveable indicia assembly thereon, constructed and arranged to be adjustable to set a predetermined score thereon.

2. The score board defined in claim 1, wherein the partition is a raised surface that extends outwardly from the back and is disposed vertically at a location between each of the counterfacing sides.

3. The score board defined in claim 2, wherein each of the close-out tokens is substantially spherical and is retained on each of the rods.

4. The score board defined in claim 1, wherein the rods extend between each of the counterfacing sides, and wherein the partition comprises a plurality of bosses each respectively located on each of the rods at respective locations thereon between each of the counterfacing sides.

5. The score board as defined in claim 1 wherein each of the close-out tokens is substantially spherical and is retained on each of the rods.

* * * * *